US007786937B1

(12) United States Patent
Stierhoff et al.

(10) Patent No.: US 7,786,937 B1
(45) Date of Patent: Aug. 31, 2010

(54) MULTI-OPERATIONAL COMBINATION AIRCRAFT ANTENNAS

(75) Inventors: Walter G. Stierhoff, Anaheim, CA (US); David J. Holloway, Whittier, CA (US)

(73) Assignee: Comant Industries, Inc., Fullerton, CA (US)

( * ) Notice: Subject to any disclaimer, the term of this patent is extended or adjusted under 35 U.S.C. 154(b) by 525 days.

(21) Appl. No.: 11/236,218

(22) Filed: Sep. 27, 2005

(51) Int. Cl.
*H01Q 1/38* (2006.01)
*H01Q 1/28* (2006.01)

(52) U.S. Cl. ..... 343/700 MS; 343/705; 343/872

(58) Field of Classification Search ..... 343/700 MS, 343/705, 872, 873, 895
See application file for complete search history.

(56) References Cited

U.S. PATENT DOCUMENTS 5,610,620 A * 3/1997 Stites et al. ..... 343/725
5,650,792 A * 7/1997 Moore et al. ..... 343/725
6,720,935 B2 * 4/2004 Lamensdorf et al. ..... 343/895

* cited by examiner

*Primary Examiner*—Michael C Wimer
(74) *Attorney, Agent, or Firm*—Leo Stanger

(57) ABSTRACT

An aircraft antenna includes an aerodynamic housing structured for attachment to an outer surface of an aircraft, and the housing contains an electromagnetic radiator and tuned over a first band of frequencies to produce a first function, and a second electromagnetic radiator to produce a second function, said radiators being arranged to decouple the first radiator and the second radiator from each other.

26 Claims, 10 Drawing Sheets

MULTI-OPERATIONAL COMBINATION AIRCRAFT ANTENNAS

RELATED APPLICATIONS

This application relates to U.S. application Ser. No. 60/589,842 filed Jul. 20, 2004. This application also relates to U.S. application Ser. No. 10/755,033 Filed Jan. 9, 2004 For "Combination Aircraft Antenna Assemblies", which claims the benefit of Ser. No. 60/439,252 filed Jan. 10, 2003 entitled "Combination Antennas" and U.S. Application Ser. No. 60/439,381 filed Jan. 10, 2003 entitled "Combination Antennas". This invention also relates to U.S. Applications Ser. No. 60/533,113, filed Dec. 29, 2003, U.S. Application Ser. No. 60/530,124 filed Dec. 17, 2003, a provisional application entitled Multiple Aircraft-Antenna Assemblies Ser. No. 60/589,842 filed Jul. 20, 2004, a provisional application entitled Multifunction Combination Aircraft Antennas Ser. No. 60/606,598 filed Sep. 1, 2004, a non-provisional application entitled Multifunction Combination Aircraft Antennas filed Oct. 7, 2004 Ser. No. 10/960,394, and a provisional application filed Oct. 1, 2004 entitled Multi-Operational Combination Aircraft Antennas Ser. No. 60/615,404. The content of these applications are hereby incorporated by reference into this application as if fully recited therein.

Applicant claims the benefit of all these applications under 35 USC 120.

FIELD OF THE INVENTION

This invention relates to multi-operational combination aircraft antennas, and particularly to individual aircraft antennas operational in multiple frequency bands and performing multiple functions.

BACKGROUND OF THE INVENTION

Aircraft require a large array of antennas for navigational, communication, entertainment, and other purposes. The antennas perform various specialized functions at individual frequency bands that must not interfere with each other. Each antenna represents a potential projection from the surface of the aircraft, and such projections may create drag and instabilities that slow and otherwise affect the aircraft's performance adversely. A single aircraft may support as many as twenty antennae that extend from the aircraft surface into the airstream about the surface.

SUMMARY OF THE EMBODIMENTS OF THE INVENTION

According to an embodiment of the invention antenna projections from the surface of an aircraft are reduced by combining multiple antenna functions under one aviation radome and arranging the systems inside the radome to limit interference and crosstalk.

These and other features of the invention are pointed out in the claims. Other aspects of the invention will become evident from the following detailed description when read in light of the accompanying drawings.

DETAILED DESCRIPTION OF THE PREFERRED EMBODIMENTS

Figure 1:
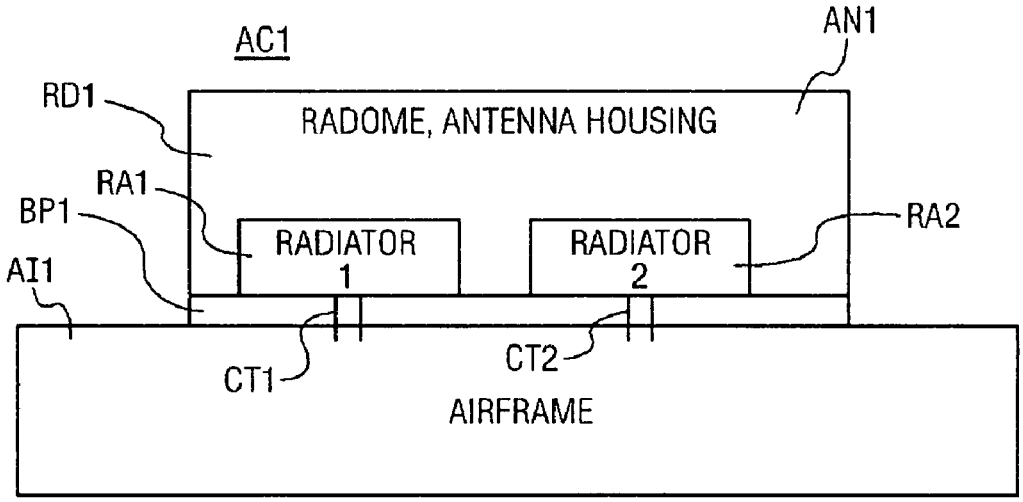
FIG. 1 is a generalized schematic illustration of an antenna mounted on an airframe and embodying features of the invention.

In FIG. 1, a schematically-illustrated aircraft AC1 embodying the invention includes a schematically exemplified airframe AI1 and a schematically-shown multi-operational combination antenna AN1 also embodying the invention. The antenna AN1 includes an antenna housing or radome RD1 that and rests securely on the outer and upper surface of the airframe AI1 such as on a wing or fuselage. The term airframe includes all parts of the aircraft including its outer shell. The term radome as used herein is not limited to any particular shape. The radome RD1 includes a base plate BP1. Suitable means secure the radome RD1 to the outer surface or the shell of the airframe AIL A transmitter/receiver system (not shown), which may be located in the antenna AN1 or connected to the antenna from inside the aircraft, may include one or more transmitters or receivers, drives and receives signals from the antenna AN1.

The antenna system AN1 includes a radiator RA1 and a separate radiator RA2 mounted on the base plate BP1. The term radiator is intended to include both a transmitting antenna element and a receiving antenna element. According to one embodiment of the invention, each radiator RA1 and RA2 includes an internal amplifier and according to another embodiment it operates without an internal amplifier but uses the receiver or transmitter, located inside the airframe AI1, to which it is connected. Connectors CT1 and CT2 connect the radiators RA1 and RA2 to the receiver or transmitter through the base plate BP1.

Figure 2:
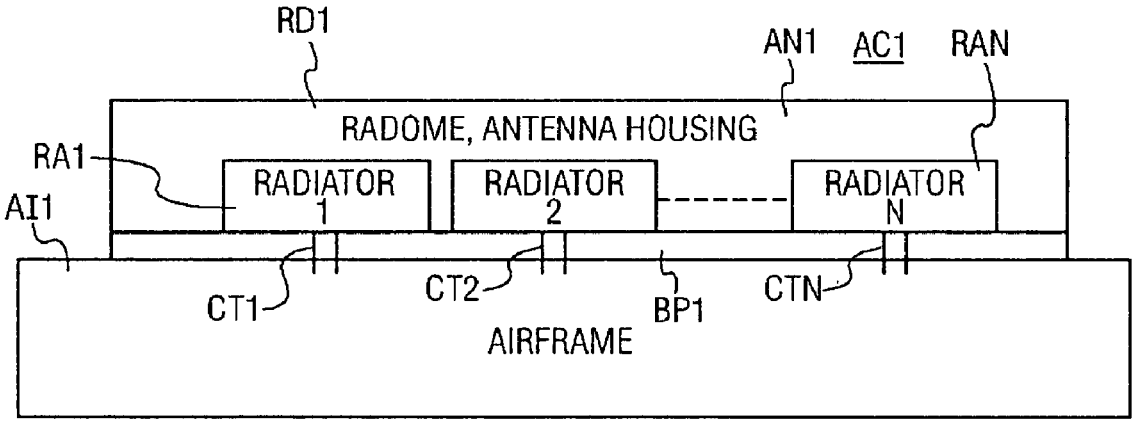
FIG. 2 is a generalized schematic diagram of another antenna mounted on an airframe and embodying features of the invention.

FIG. 2 illustrates another aircraft AC1 with an airframe AI1 supporting an antenna AN1 with a radome RD1 that envelops an antenna system AS1. However here the antenna system includes N radiators RA1, RA2, . . . RAN. As in FIG. 1, each radiator RA1, RA2 . . . RAN may include an internal amplifier or it may operate without an internal amplifier and use a receiver or transmitter, which is located inside the airframe AI1 and to which it is connected. Connectors CT1, CT2, . . . CTN connect the radiators RA1, RA2 . . . RAN to the receiver or transmitter through the base plate BP1.

Figure 3:
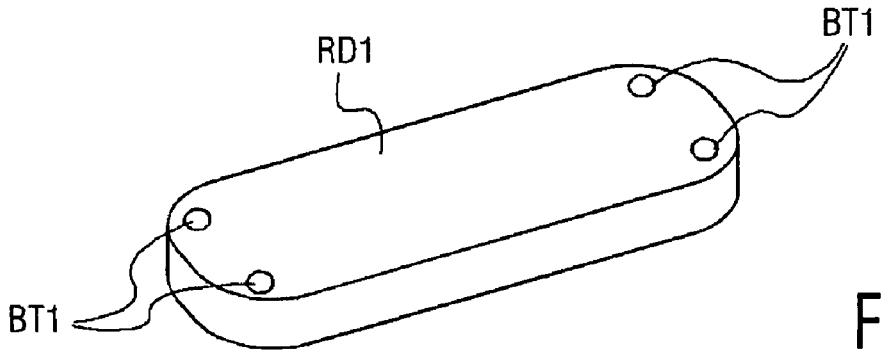
FIG. 3 is a perspective view of an example of an antenna in FIG. 1 and FIG. 2.
Figure 4:
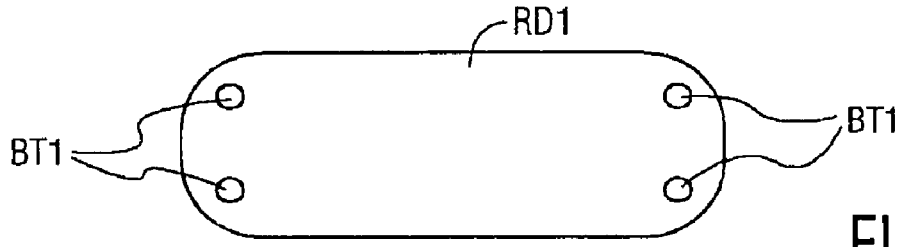
FIG. 4 is a plan of the example of the antenna in FIG. 3 embodying features of the invention.
Figure 5:
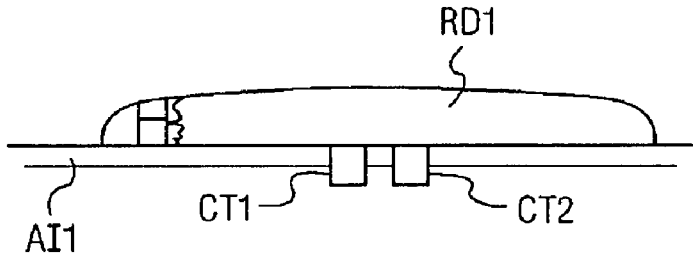
FIG. 5 is an elevation of the antenna in FIGS. 4 and 5 mounted on an airframe and embodying features of the invention.
Figure 6:
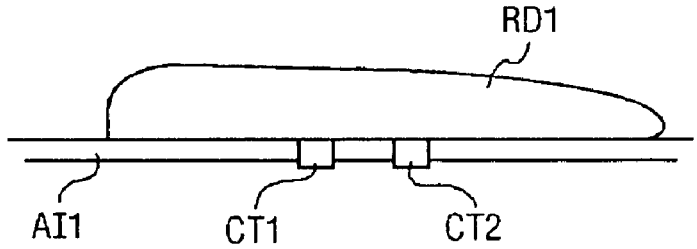
FIG. 6 is another example of an antenna shown in FIGS. 1 and 2 mounted on an airframe and embodying features of the invention.
Figure 7:
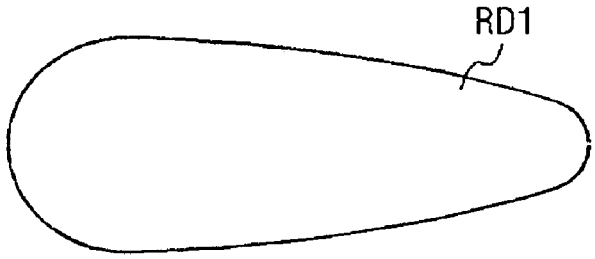
FIG. 7 is a plan view of the antenna in FIG. 6.

According to various embodiments of the invention, the radome RD1 takes any of a number of forms. For example, according to one embodiment, the antenna housing or radome RD1 exhibits a high-speed low-profile bar-of-soap-shaped structure, a perspective view of which appears in FIG. 3, a plan view in FIG. 4, and an elevation in FIG. 5. According to another embodiment the radome RD1 assumes a teardrop shape as shown in elevation in FIG. 6, an in plan view in FIG. 7. According to another embodiment, the radome RD1 forms a blade housing BH1 and appears in cross-sectional elevation in FIG. 8 and a view from below in FIG. 9. According to other embodiments of the invention, the antenna forms a whip housing, or other appropriate shape for aircraft AC1. The base plate BP1 in FIG. 8 forms part of the housing or radome RD1 and supports the radiators RA1, RA2, and RA3. In this case the radiator RA1 is a monopole. Suitable means, such as bolts BT1 shown in FIGS. 3, 4, and 5 secure the radome RD1 to the outer surface of the shell of the airframe AI1. Connectors CT1 appearing for example in FIGS. 5, 6, 8, and 9 project from the radiators RA1, RA2, and RA3 through the base plate and the shell of the airframe AI1 to furnish signals to a receiver or transmitter.

Figure 8:
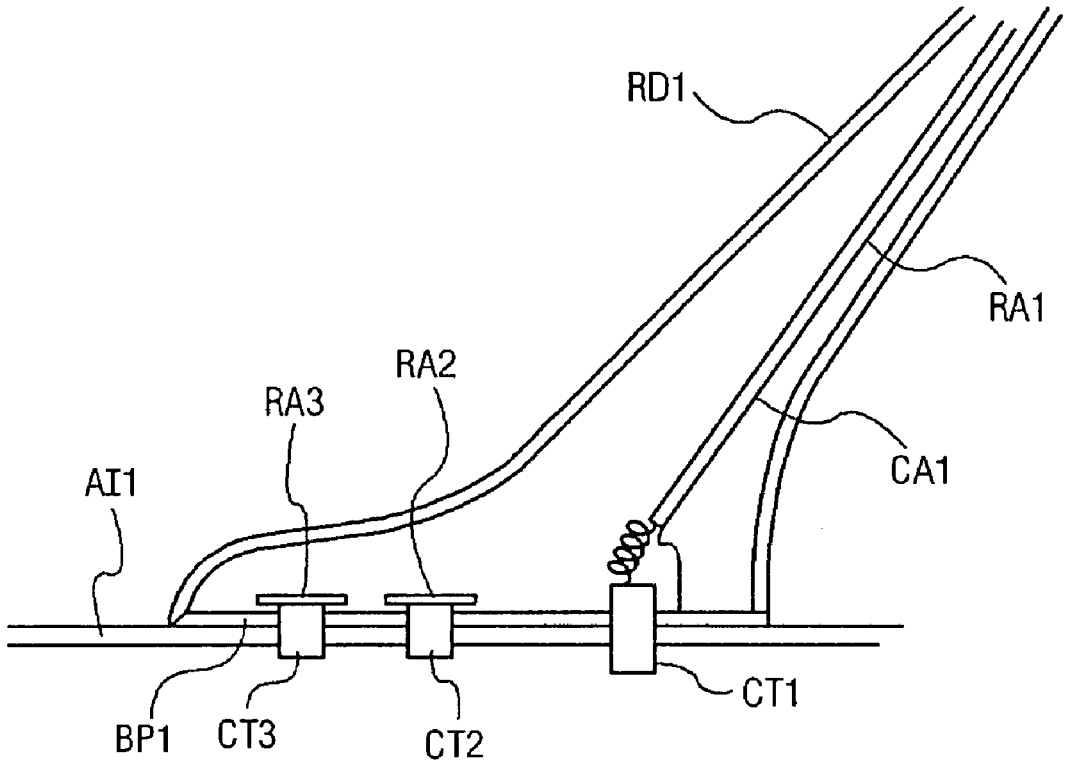
FIG. 8 is another example of an antenna shown in FIGS. 1 and 2 mounted on an airframe and embodying features of the invention.
Figure 9:
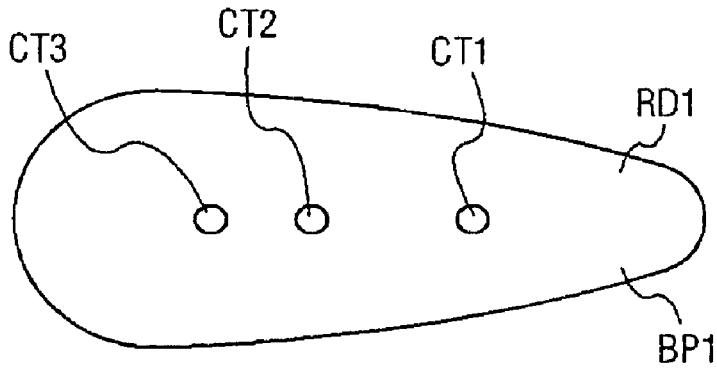
FIG. 9 is a bottom view of the antenna in FIG. 8.

In the blade-shaped radome or housing RA1 in FIGS. 8 and 9 the radiator RA1 takes the form of a VHF monopole with a communications conductor antenna CA1 that extends from the base plate BP1 at the airframe AI1 upwardly along the length of the blade-shaped radome. Two or more patch radiators RA2, RA3, . . . RAN extend parallel to the base plate BP1.

The radiators RA1, RA2, . . . RAN may take various forms and perform various functions. According to an embodiment, for example, one of the radiators RA1, RA2, . . . RAN in FIGS. 1 to 7 may constitute a helix or quadrifilar-helix antenna element with right hand circular polarization (RHCP) or left hand circular polarization (LHCP) or linear polarization. According to another embodiment one of the radiators RA1, RA2, . . . RAN is a patch radiator element or a stacked patch arrangement.

According to various embodiments of the invention, the radiators RA1, RA2, . . . RAN perform any one of a number of functions. In one example, any one of the patch radiators RA1, RA2, . . . RAN in FIGS. 1 to 9 functions as a GPS L1 device operating for example in a range 1575.42±3 MHz. According to another embodiment any one of the radiators RA1, RA2, . . . RAN operates in the weather service range from 1544.5 to 1558 MHz. According to another embodiment the any one of the radiators RA1, RA2, . . . RAN functions as and ELT or Emergency Locator Transmitter operating for example at 121.5 MHz, 243 MHz, and 406 MHz. According to another embodiment the one of the radiators RA1, RA2, . . . RAN functions in the XM Satellite range at 2332.5 to 2345.0 MHz. According to another embodiment the one of the radiators RA1, RA2, . . . RAN operates in the Sirius range at 2330.0 to 2332.5 MHz. According to another embodiment the one of the radiators RA1, RA2, . . . RAN functions as a Military GPS L2 device operating for example at 1,227.60 MHz. According to still another embodiment the one of the radiators RA1, RA2, . . . RAN functions in the GLONASS Russian GPS service operating for example at 1,602.5625-1615.5 and 1240-1260 MHz. According to still another embodiment the one of the radiators RA1, RA2, . . . RAN is a VHF radiator operating for example at 118-137 MHz. The frequencies here are given only as examples, where appropriate, and other frequencies may be substituted therefor. In each radome, each radiator RA1, RA2, . . . RAN performs a different one of these functions, although it is possible for two radiators to perform the same function.

The shape of the radome RD1 is as symmetrical as possible and of uniform thickness to preserve radiation pattern symmetry. A dielectric material DM1 fills the radome RD1 up to the radiators RA1 and RA2, and RA1, RA2, . . . RAN, and other antenna elements, to form a moisture barrier, to hold the components together, to control any frequency shift, and to adjust the radiators or other antenna elements to compensate for tuning shifts.

According to embodiments of the invention, where a number of radiators RA1 and RA2 of FIG. 1, or RA1, RA2 . . . RAN of FIG. 2 are patches, adjacent patches assume the positions shown in FIG. 10 or FIG. 11 to decouple their radiation and limit crosstalk. Here, each radiator performs a distinct function and constitutes one of the patch radiators RA1 and RA2, or RA1, RA2 . . . RAN in any of FIGS. 1 to 9. The orientations and distances between the patches or any of the radiators RA1 and RA2, or RA1, RA2 . . . RAN of FIGS. 1 to 9 effect decoupling between the radiators. Other embodiments achieve additional decoupling by the use of filters.

Figure 10:
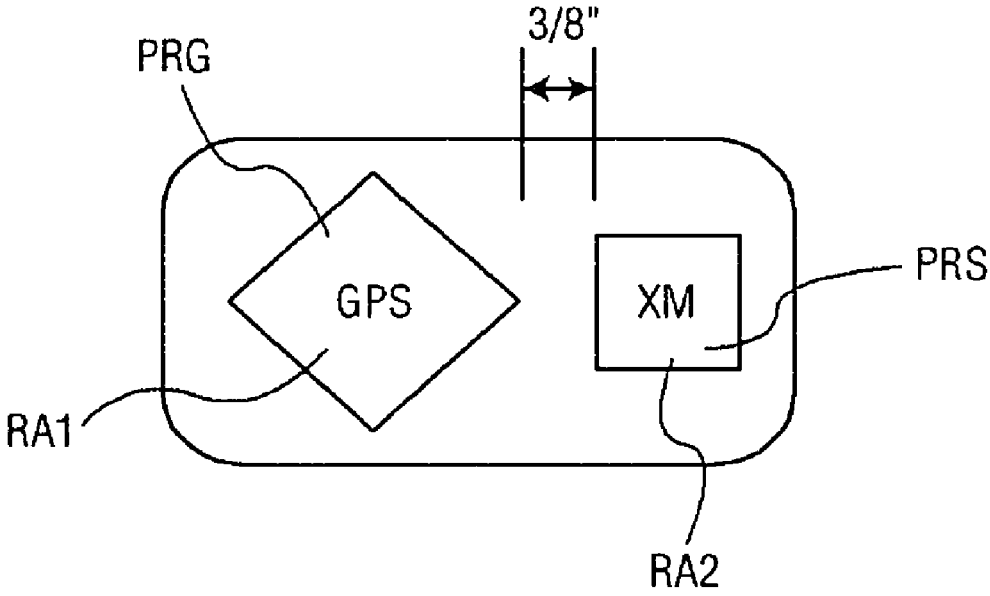
FIG. 10 is a schematic plan of an example of an arrangement inside the antenna in FIGS. 1 to 5.

In FIG. 10 two radiators RA1 and RA2 perform different functions, such as operating as GPS and XM radiators. The point to edge orientation as shown represents relative positions producing low crosstalk and coupling. This permits small spacing between the elements for a specific low coupling and crosstalk. The distance between the two elements may for example be ⅜"±⅛".

Figure 11:
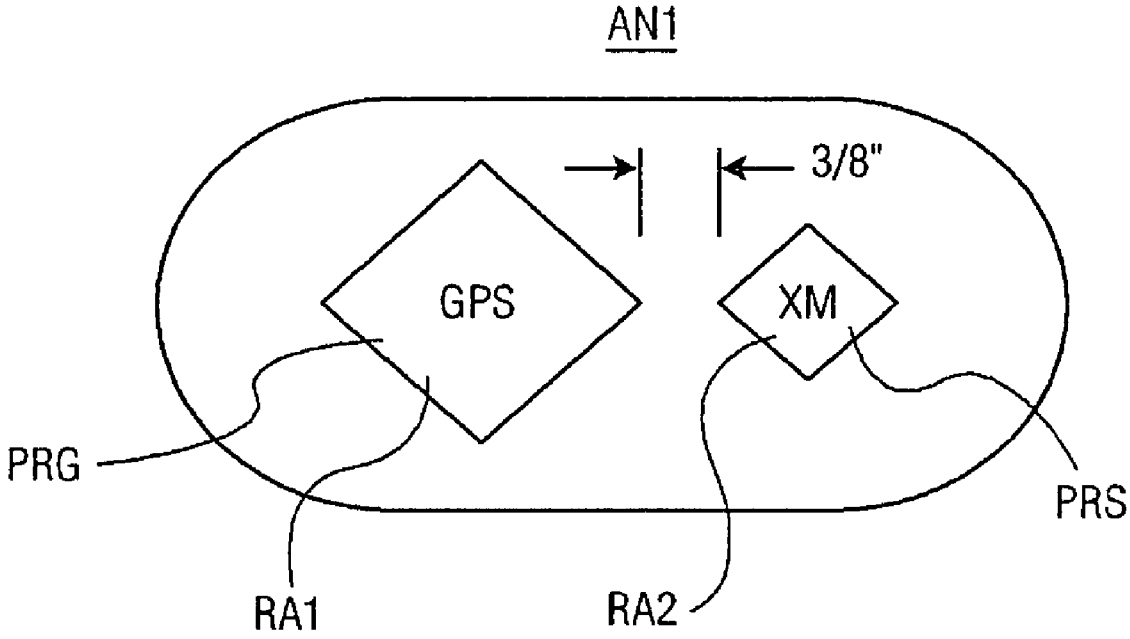
FIG. 11 is a schematic plan of another example of an arrangement inside the antenna in FIGS. 1 to 5.
Figure 12:
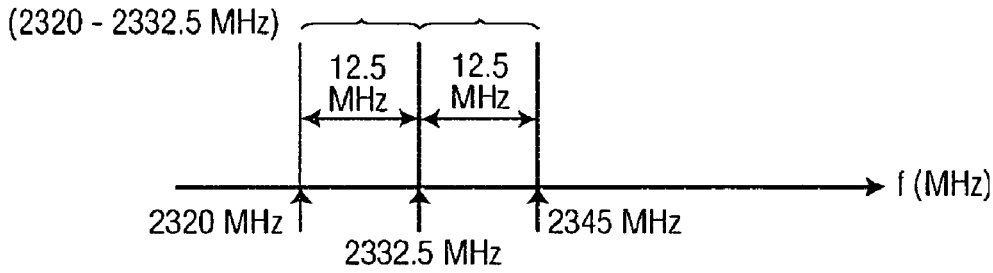
FIG. 12 is a diagram showing the frequency bands of XM satellite radio and Sirius Satellite Radio.

FIG. 11 illustrates yet another embodiment of the invention. Here the antenna AN1 includes patch radiators RA1 and RA2 in tip-to-tip or point-to-point relationship. This orientation helps minimize crosstalk and coupling between the radiators. In FIG. 11, one of the radiators RA1, RA2, . . . RAN encased in the radome RD1 takes the form of a GPS patch radiator PRG (1,575.42 MHz). The other radiator adjacent the patch radiator PRG is a satellite patch radiator PRS, tuned to receive both the Sirius Satellite Radio (2320.0 to 2332.5 MHz) frequency band and the XM Satellite Radio (2332.5 to 2345.0 MHz) frequency bands. These ranges appear in FIG. 12.

In the GPS radiator RA1, RA2, . . . RAN, a GPS preamplifier PA1 under the GPS patch radiator PRG receives GPS signal input via a GPS patch feed point FP1 and outputs amplified signals to the GPS receiver RE1 via a connector CT1, CT2, CT3 . . . In the radiator RA2, a satellite preamplifier PA2 under the satellite patch radiator PRS receives satellite signal input via a satellite patch feed point and outputs amplified signals to the satellite radio receiver via connector CT1, CT2, CT3. . . . Respective shorting pins in the patch radiator PRS and patch radiator PRG serve as DC grounds. According to an embodiment, a can surrounds the GPS preamplifier under the GPS patch radiator PRG to shield the GPS preamplifier from radiation, and a can surrounds the satellite preamplifier under the satellite patch radiator shield the satellite preamplifier from radiation.

The satellite radio receives both audio entertainment and digital data channels from one or both the Sirius and XM Satellite Radio satellites. The GPS receiver GP1 receives navigation data from the GPS constellation of satellites.

In FIGS. 10 and 11, the radiators RA1 and RA2 are described as GPS and PRS satellite radiators only as an example of the functions they can perform. According to embodiments of the invention the radiators RA1 and RA2 can have the structure or function of any patches described in FIGS. 1 and 2.

In one embodiment of the antenna as shown in FIGS. 10 and 11, the one of the radiators RA1, RA2, . . . RAN operates at GPS over the GPS frequency range and the radiator RA2 operates in the WSI (Weather Data) range. The orientation of the radiators RA1 and RA2 limits the interference and cross talk between these two bands.

Figure 13:
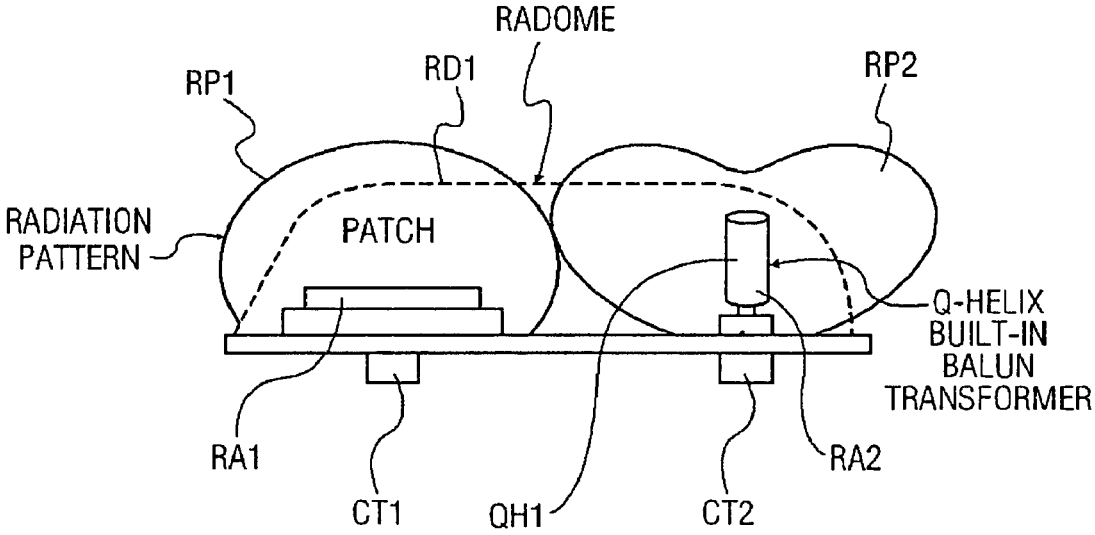
FIG. 13 is a schematic diagram showing an example of two radiators mounted in an antenna embodying features of the invention.

FIG. 13 illustrates another embodiment of the invention. Here the radome RD1 encloses a Quadrifilar Helix QH1 with a built-in Balun transformer, and a patch RA1. The patch radiator RA1 exhibits a narrow bandwidth and a hemispherical radiation pattern RP1. Making the patch thicker permits increasing the bandwidth. The Quadrifilar Helix QH1 exhibits a broad bandwidth whose operation may be modified by selecting the helix pitch. The Quadrifilar Helix QH1 helix exhibits a cardioid radiation pattern RP 1 when viewed from the side.

All of these embodiments with patch radiators involve any of patch radiators with right hand circular polarization (RHCP) or left hand circular polarization (LHCP). In other embodiments a monopole produces linear polarization.

Figure 14:
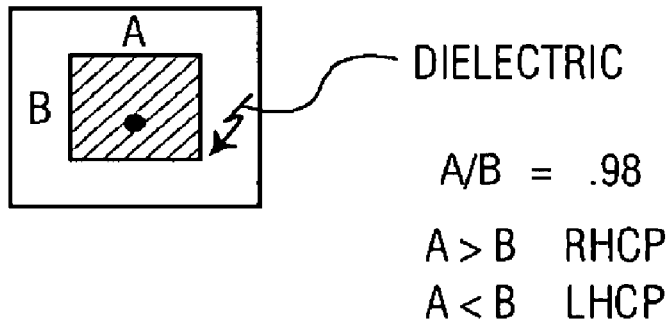
FIG. 14 is a schematic the relationship of dimensions in a radiator of the antennas in FIGS. 1 to 13.

FIG. 14 illustrates the effect of the dimensions of the metal electrode of a patch relative to its supporting dielectric. Where A>B the polarization is RHCP and where A<B the polarization is LHCP.

According to another embodiment of the invention, any one of the radiators

Figure 15:
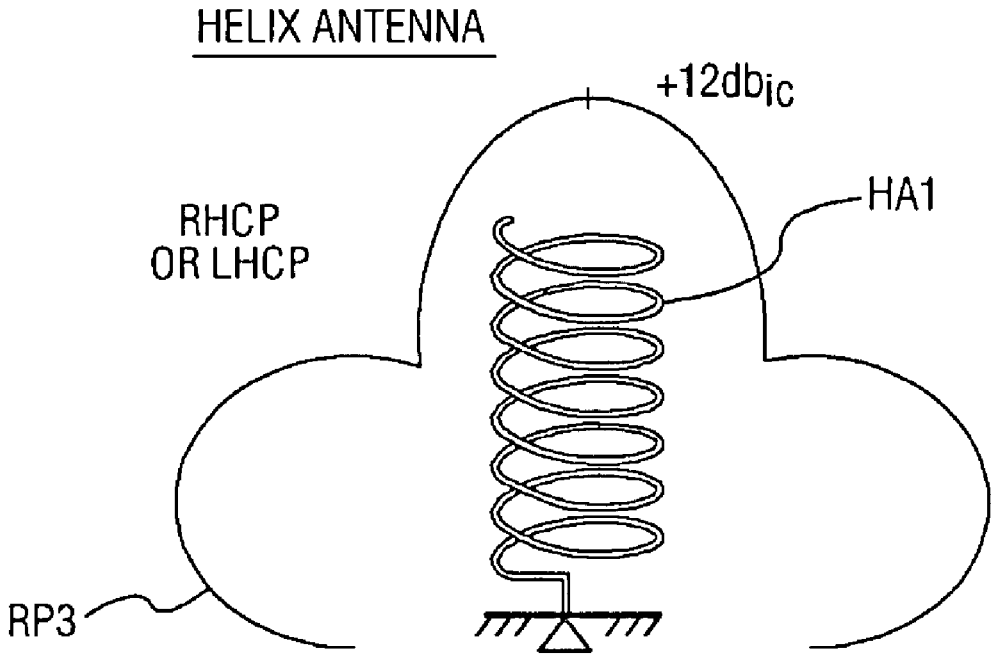
FIG. 15 is a schematic diagram showing the radiation pattern of a helix radiator.

RA1, RA2, RA3, . . . may be a simple helix with right hand circular polarization (RHCP) or left hand circular polarization (LHCP). A helix antenna HA1 with an RHCP or LHCP exhibits a radiation pattern RP3 as shown in FIG. 15.

Figure 16:
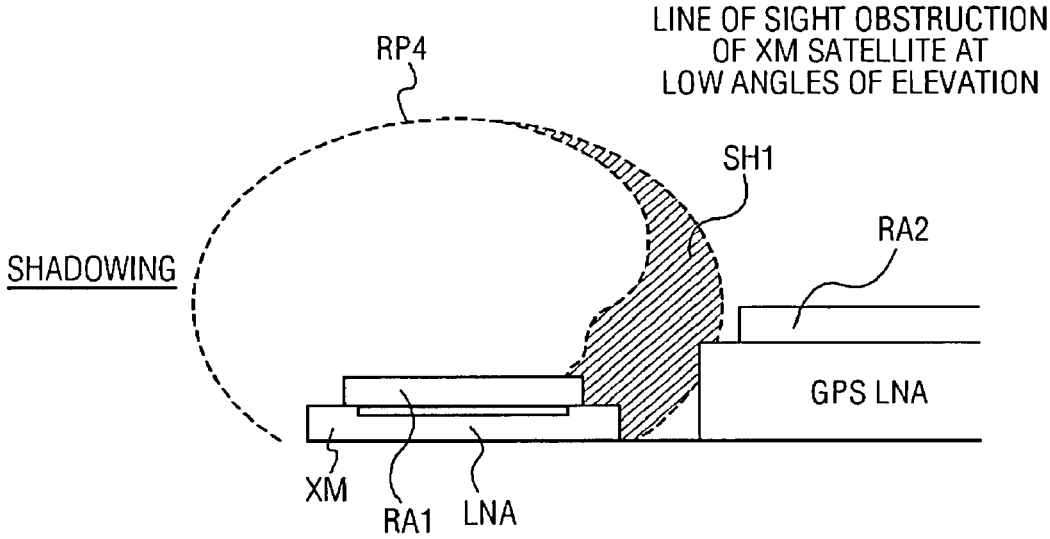
FIG. 16 is a schematic diagram of a pair of patch radiators in an antenna showing problems of shadowing.
Figure 17:
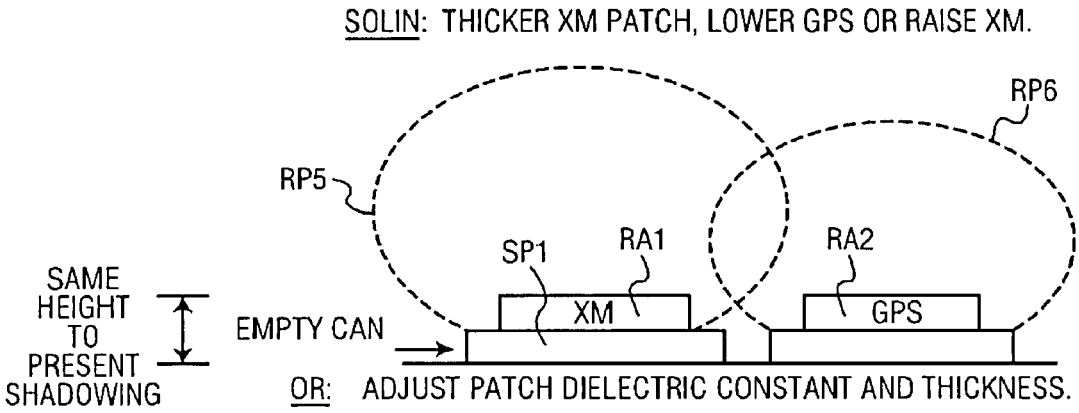
FIG. 17 is a plan schematic diagram of a pair of patch radiators in an antenna arranged to alleviate problems of shadowing according to the invention.

In some instances the top of one patch radiator towers over an adjacent patch radiator and produces a type of shadowing shown in FIG. 16. There, the top of an XM satellite radiator RA1 (for example) is lower than a GPS radiator RA2 and the thicker or higher GPS radiator forms line-of sight obstruction of the XM satellite radiator RA1 at low angles of elevation. Both radiators rest on low noise amplifiers LNA. The difference in the levels of the tops of the radiators RA1 and RA2 in FIG. 16 forms a radio-frequency shadow to XM radiation, which distorts the radiation pattern RP4 of the XM radiator RA1. Optimizing performance of an antenna with adjacent patch radiators requires eliminating the shadowing of FIG. 16. An embodiment of the invention involves placing the tops of the adjacent radiators at the same level as shown in FIG. 17. According the various embodiments, this is accomplished by making the patch XM satellite radiator RA1 thicker, by lowering the GPS radiator RA2, or by raising the XM satellite radiator RA1. The arrangement in FIG. 17 alleviates the shadowing of FIG. 16 so that acceptable radiation patterns RP5 and RP6 result. Accomplishing the end of keeping the levels of the tops of the radiators equal may involve using an empty can to form a support platform SP1 under the structure of the XM satellite radiator RA1 to raise its top to the level of the top of the GPS radiator RA2, or by using empty cans under both patch structures to form support platforms to bring their tops to same level. Other embodiments involve adjusting the thicknesses of the patch dielectrics to produce tops at equal heights and adjusting the dielectric constants of each patch dielectric to accommodate the thickness changes.

Figure 18:
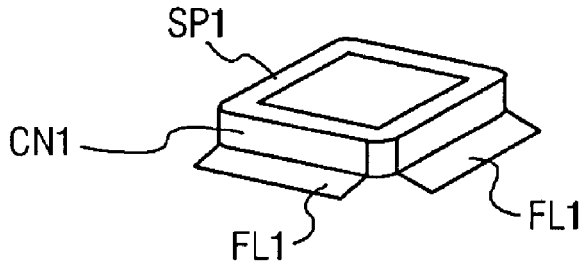
FIG. 18 is a perspective view of a platform to alleviate problems of shadowing according to the invention as shown in FIG. 17.
Figure 19:
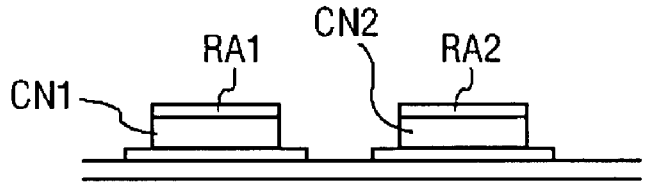
FIG. 19 is an elevation of radiators, having platforms to alleviate problems of shadowing according to the invention as shown in FIG. 17.
Figure 20:
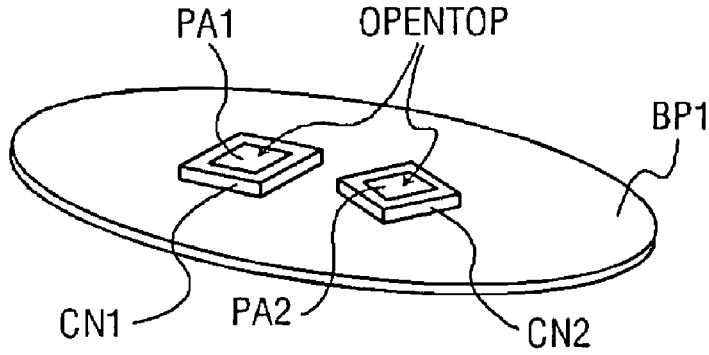
FIG. 20 is a perspective view of FIG. 19.
Figure 21:
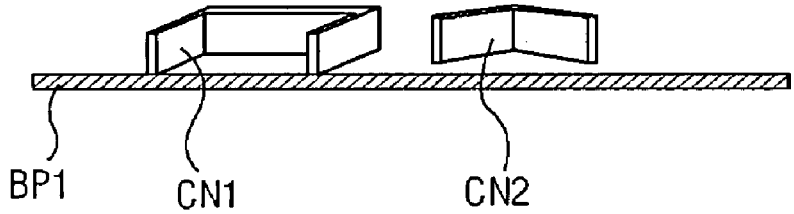
FIG. 21 is elevation of FIG. 20

FIG. 18 illustrates a support or platform SP1 in the form of a hollow brass can CN1, for example, for raising the top of XM radiator to the level of the top of the GPS radiator. The support can CN1 is cut out on top and contains flanges FL1 at the bottom for fastening, such as by soldering, to the base plate BP1. In one embodiment, separate platforms in the form of cans maintain the tops of both the XM radiator and the GPS radiator at the same level. FIG. 19 is an elevation showing the arrangement with two separate support cans CN1 and CN2. FIG. 20 illustrates the separate cans CN1 and CN2 mounted on the base plate BP1 with machined or cutout cavities in the base plate for preamplifiers PA1 and PA2. FIG. 21 shows another elevation with cans CN1 and CN2 on a base plate BP1.

Figure 22:
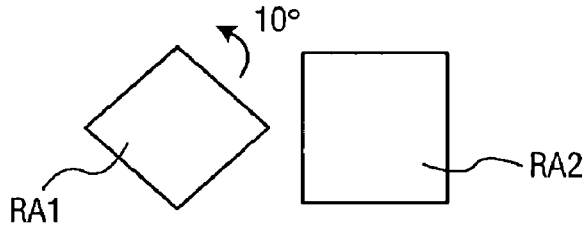
FIG. 22 is a schematic diagram illustrating radiator orientation according to an embodiment of the invention.

Adjusting the coupling between adjacent patches involves spacing the patches from each other. As shown in FIG. 22, it also entails varying the angular relationship of the patch edges relative to each other. In FIG. 22 radiator RA1 is oriented 45 degrees relative to the radiator RA2. Such relationship may be further shifted 10 degrees. A combination of spacing and angular relationship can achieve a desired end.

Figure 23:
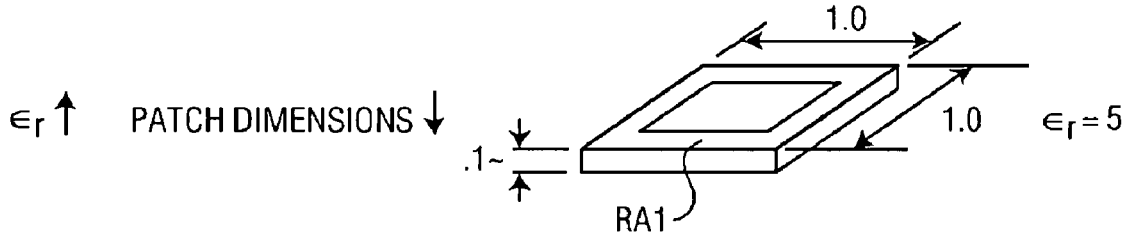
FIGS. 23 to 26 illustrate the effects of patch dimensions and positions.
Figure 24:
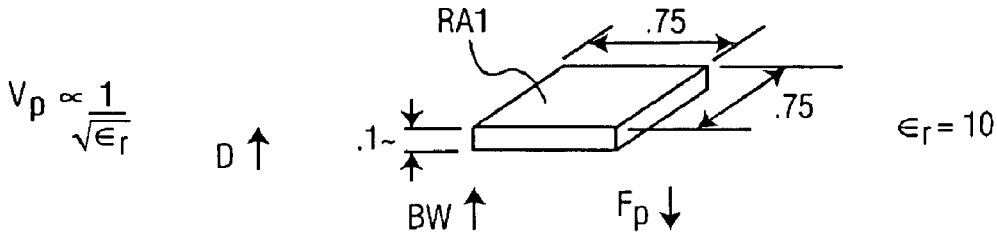

According to another embodiment of the invention, the gain of the XM patch and the GSM patch are optimized, while minimizing shadowing, by adjusting the patch dimensions to the patch dielectric constant $\in_r$ of each patch's dielectric material. Increased patch dimensions accompany decreasing $\in_r$. Decreased patch dimensions accompany an increasing $\in_r$ as shown in FIGS. 23 and 24. Increasing the patch thickness can make the patch heights of adjacent patches equal and thereby reduce shadowing. It also increases the bandwidth and lowers the gain.

Figure 25:
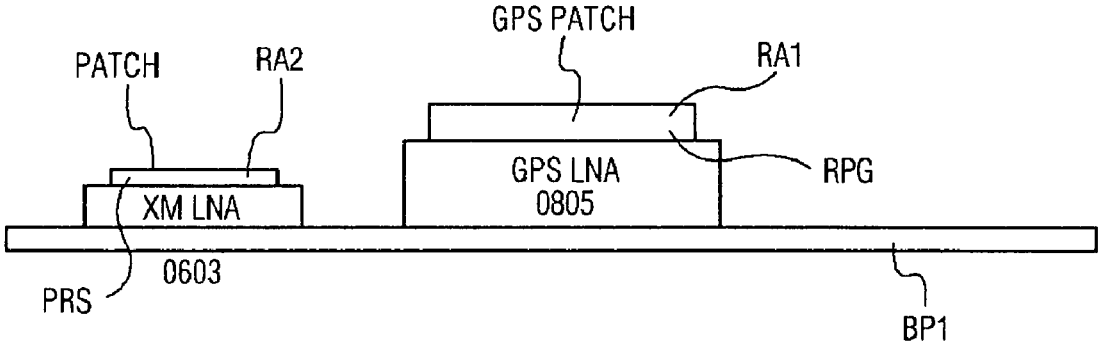
Figure 26:
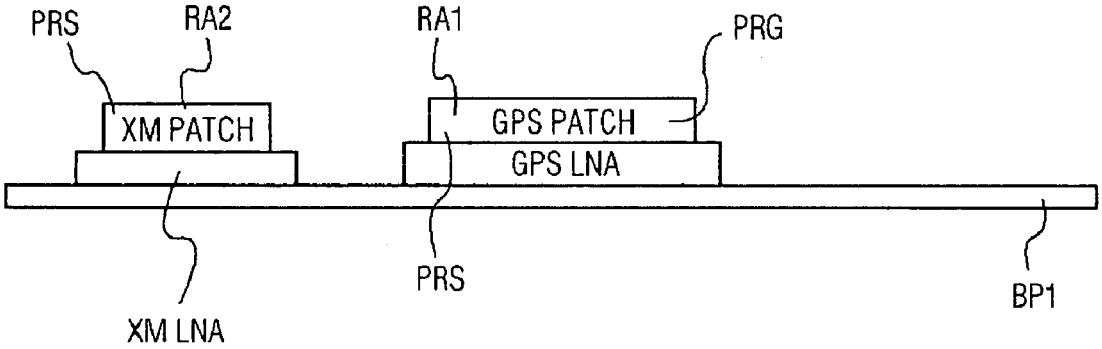

A pair of patches mounted on a base plate at unequal heights appears in FIG. 25. The higher GPS patch PGR can cause shadowing of the XM patch PRS. The height of the GPS patch PRG arises from a large fiber or large PCB compound supporting the patch or from a large TNC connector projecting into the base plate. FIG. 26 shows the XM patch PRS and the GPS patch at the same level. Increasing the XM patch thickness may result in a drop in the gain of the XM patch. However raising the XM patch with a can avoids this drop in gain.

The references to GPS and XM patches in the above are only examples and the invention contemplated other pairs of adjacent patches.

According to various embodiments, the patch radiators are grounded or not. Repeatable accurate positioning of patches on manufactured base plates involves machining or casting precision cavities in the base plates. Placing any radome mounting hardware at a level below the patch radiator prevents shadowing from such hardware. The radomes exhibit symmetry and uniform thickness as much as possible to preserve the radiation pattern symmetry. A dielectric material fills all radomes, forms a moisture barrier, holds the components together, but introduces a dielectric frequency shift. Compensating for this shift, according to an embodiment, entails adjusting the antenna elements.

While embodiments of the invention have been described in detail, it will be evident to those skilled in the art that the invention may be embodied otherwise within its spirit and scope.

What is claimed is:

1. An aircraft antenna, comprising:

a base plate for mounting on an aircraft;

a housing covering the base plate and form a space between the housing and the base plate;

a plurality of radiators in said space and mounted on said base plate;

said radiators each having a separate function and operating at separate frequency bands relative to each other;

said housing forming a radome said radiators each being a patch radiator or a helix antenna, said radiators include two patches mounted on the base plate horizontally adjacent one another, said two patches having unequal thicknesses, and a radiation-shadow-reducing platform under one of said patches to place the tops of said two patches at the same level above the base plate.

2. An antenna, as in claim 1, wherein said base plate is arranged for mounting on an aircraft for travel through air and said housing being arranged to provide minimal aerodynamic resistance to air.

3. An antenna as in claim 1, wherein said radiators are each patch radiators.

4. An antenna as in claim 1, wherein two of said radiators are patch radiators and another of said radiators is a helix antenna.

5. An antenna as in claim 1, wherein said housing exhibits a bar-of-soap shape.

6. An antenna as in claim 1, wherein said housing exhibits a teardrop shape.

7. An antenna as in claim 1, wherein said housing exhibits an aerodynamic blade shape.

8. An antenna as in claim 1, wherein said housing exhibits an aerodynamic blade shape enclosing two of said radiators and a monopole.

9. An antenna as in claim 1, wherein said housing exhibits an aerodynamic blade shape enclosing said two patches and a monopole.

10. An antenna as in claim 1, wherein a pair of said radiators are each patch radiators each having a rectangular shape, and wherein said patch radiators are oriented in point to edge relationship and spaced from each other.

11. An antenna as in claim 1, wherein a pair of said radiators are each patch radiators each having a rectangular shape, and wherein said patch radiators are oriented in edge to edge relationship and spaced from each other.

12. An antenna as in claim 1, wherein one of the radiators functions as a GPS L1 device or Weather Service International or as and ELT or Emergency Locator Transmitter or XM Satellite or Sirius Satellite or as a Military GPS L2 or GLONASS or a VHF radiator.

13. An antenna as in claim 1, wherein another of the radiators functions as a GPS L1 device or Weather Service International or as an ELT or Emergency Locator Transmitter or XM Satellite or Sirius Satellite or as a Military GPS L2 or GLONASS or a VHF radiator, but performs a function different from the one of the radiators.

14. An antenna as in claim 1, wherein one of said radiators is a quadrifilar helix radiator.

15. An antenna as in claim 1, wherein one of said radiators is a patch radiator with a right hand circular polarization.

16. An antenna as in claim 1, wherein one of said radiators is a patch radiator with a left hand circular polarization.

17. An antenna as in claim 1, wherein said helix antenna is radiator with a right hand circular polarization.

18. An antenna as in claim 1, wherein said helix antenna has a left hand circular polarization.

19. An antenna as in claim 1, wherein said housing exhibits an aerodynamic blade shape enclosing said two patches and a monopole having linear polarization.

20. An antenna as in claim 1, wherein said housing exhibits an aerodynamic blade shape enclosing said two patch radiators and a monopole having linear polarization.

21. An antenna as in claim 1, wherein said two patches with said platform have upper levels of equal height above the base plate and said platform includes an amplifier.

22. An antenna as in claim 1 wherein said platform is in the form of a hollow can on said base plate.

23. An antenna as in claim 1, wherein said platform is a brass hollow can.

24. An antenna as in claim 1, wherein said base plate is machined to align the tops of said patches to the same level.

25. An antenna as in claim 1 wherein radiators include two patches said base plate includes precision cavities that form the one platform and a second platform to align said patches to the same level.

26. An antenna as in claim 1, wherein said radiators include the two patches and one of said patches has its dielectric adjusted to adjust its height above the base plate relative to the other of said two patches.

* * * * *